US006715985B2

(12) United States Patent
Delrahim et al.

(10) Patent No.: US 6,715,985 B2
(45) Date of Patent: Apr. 6, 2004

(54) GAS CONDITIONING SYSTEM

(75) Inventors: Joe Delrahim, Deerfield, IL (US); Vladimir Bakalchuk, Skokie, IL (US)

(73) Assignee: John Crane Inc., Morton Grove, IL (US)

( * ) Notice: Subject to any disclaimer, the term of this patent is extended or adjusted under 35 U.S.C. 154(b) by 2 days.

(21) Appl. No.: 10/147,613

(22) Filed: May 15, 2002

(65) Prior Publication Data

US 2003/0215324 A1 Nov. 20, 2003

(51) Int. Cl.[7] ..... F04D 29/10
(52) U.S. Cl. ..... 415/26; 415/47; 415/112
(58) Field of Search ..... 415/26, 47, 110, 415/111, 112, 168.1, 170.1, 171.1, 172.1, 175, 229, 230; 277/432, 918

(56) References Cited

U.S. PATENT DOCUMENTS 3,508,758 A * 4/1970 Strub ..... 277/432
6,345,954 B1 2/2002 Al-Himyary ..... 415/112

FOREIGN PATENT DOCUMENTS

EP 800028 A1 * 10/1997 ..... F16J/15/34

* cited by examiner

*Primary Examiner*—Edward K. Look
*Assistant Examiner*—Richard A. Edgar
(74) *Attorney, Agent, or Firm*—Jenner & Block LLP

(57) ABSTRACT

A system of conditioning elements is described for supply of conditioned seal gas to the seal chamber of a rotary machine employing gas lubricated, non-contacting seals. It includes elements to remove particulate solid and liquid and volatile components from the gas and to heat the gas to a predetermined level. It also includes an element to amplify the pressure of the gas. The pressure amplifier is operative in response to a condition of the gas to be supplied to the seal chamber, to ensure that an adequate supply of seal gas is available. The system of conditioning elements may be assembled onto a single skid.

55 Claims, 1 Drawing Sheet

GAS CONDITIONING SYSTEM

This invention relates to a system for supply of seal gas to gas lubricated, non-contacting seals. More particularly, it relates to a system of conditioning elements for supply of conditioned gas to the seal chamber.

Various types of rotary devices involving pressurized gas within a housing employ gas lubricated, non-contacting seals between the rotating shaft and housing to contain the process gas within the housing. These include gas compressors, turbo-expanders, gas turbines, steam turbines, and the like, as well as pumps that have gaseous barrier fluid-type seals. U.S. Pat. No. 4,212,475 is exemplary of such gas lubricated, non-contacting seals.

The seals are disposed along the shaft and separate the pressurized process fluid chamber within the machine housing from the surrounding environment. Typically, the seal assembly is located in a seal chamber separated from the process fluid chamber by a labyrinth seal arrangement. Seal gas is supplied to the seal chamber to provide the fluid necessary for seal operation. Such gas may be from an external source, such as a nitrogen supply. Commonly though, process gas received from the equipment being sealed is the source of the seal gas. Appropriate lines and passages are provided which communicate the gas to the seal chamber through a seal gas supply system.

A system, contemplated for use in applications as described above, is shown in U.S. Pat. No. 6,345,954. That system provides a supply of process gas to the seal chamber from the discharge end of a gas compressor. This source of seal gas is not always at a pressure that exceeds the pressure of the process gas. To insure an adequate seal gas pressure, a booster compressor is employed to provide a pressure sufficient to supply seal gas for operation of the seal. Direct entry of process gas into the seal cavity, for example across the labyrinth seals, is avoided. Also, a filter of some type is disclosed which initially receives the gas supplied to the seal chamber.

The system described in U.S. Pat. No. 6,345,954 focuses on assurance of a seal gas pressure that precludes entry of process gas directly into the seal chamber. Though a filter is disclosed, no particular mention is made of gas treatment apart from pressurization. This approach does not address all needs associated with a suitable seal gas supply system. Particularly absent are arrangements for conditioning of the supplied seal gas to ensure maximum protection of the seal components and consistent non-contacting operation on a gaseous film. Such needs are most significant where the process gas is not of a quality or condition to support operation of the seal. The present invention addresses this deficiency.

Also, the system disclosed in U.S. Pat. No. 6,345,954 demands that the seal gas supply emanate from a single source, regardless of whether pressurized by the machine being sealed or by the booster compressor. Such an arrangement does not contemplate an alternate source of a gas supply for booster compressor operation.

In addition, operation of the system is dependent upon the sensing of pressure differential between the inlet and discharge of the machine being sealed. This approach does not provide the advantage attendant to more direct recognition of the need to amplify or augment the seal gas pressure level as is contemplated by the present invention.

SUMMARY OF THE INVENTION

The present invention is directed to a system for supply of conditioned seal gas to the seal chamber of a rotary machine employing gas lubricated, non-contacting seals. In a broadest form, it includes conditioning elements to remove particulate solid and liquid and volatile components from the gas which would be disruptive of seal operation or deleterious to seal durability as well as to heat the gas to a predetermined level, if necessary, to ensure a continuous supply of gaseous fluid for seal operation. The system may also include an element to amplify pressure of the seal gas. The amplification element is responsive to sensing of a condition of the gas to be supplied to the seal chamber to operate the pressure amplifier and ensure that an adequate supply of seal gas is available at the requisite pressure. The conditioning elements may be assembled onto a single skid.

DESCRIPTION OF ILLUSTRATED EMBODIMENTS

Figure 1:
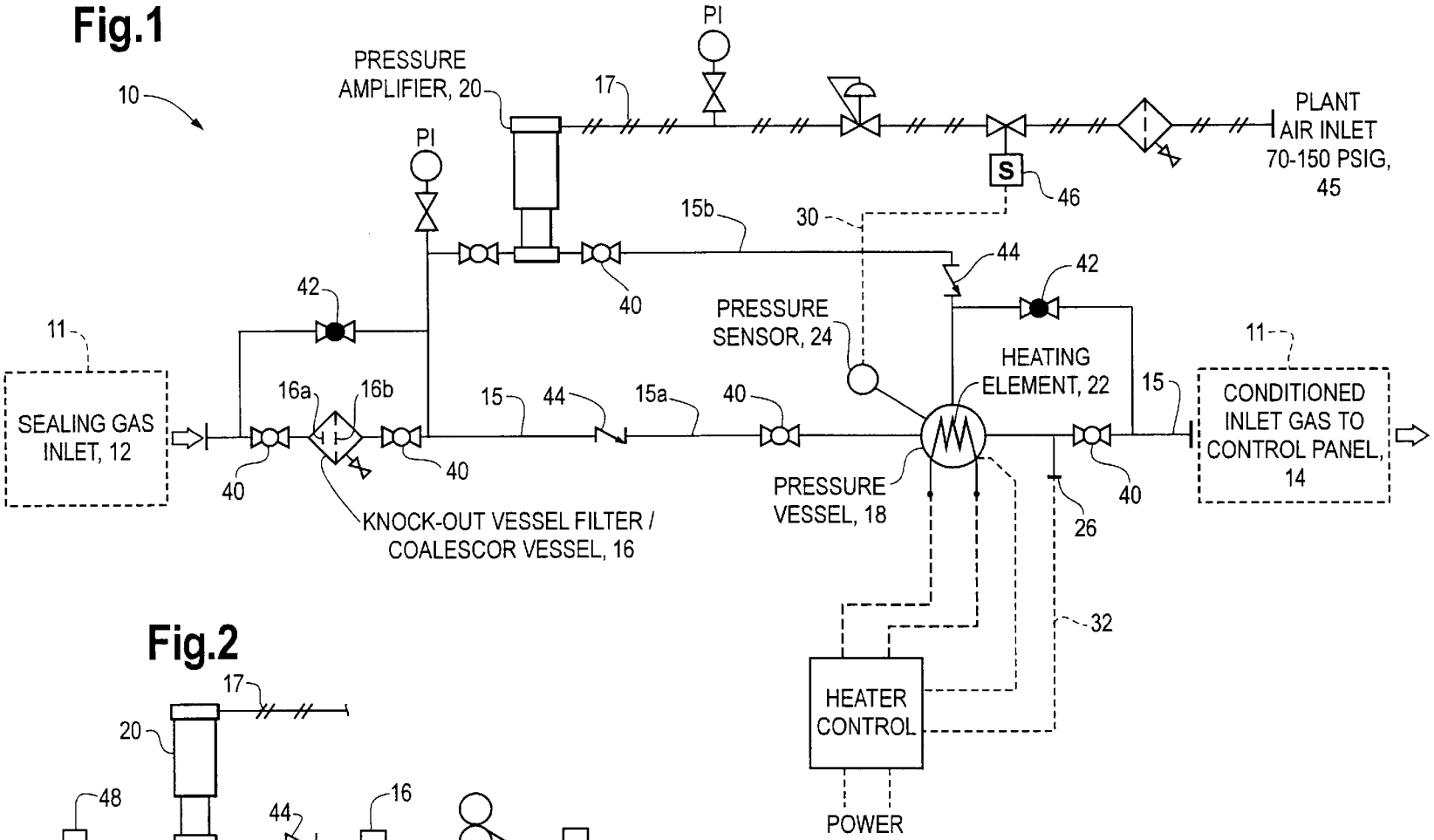
FIG. 1 is a schematic view of a gas supply system embodying principles of the present invention.

Referring to FIG. 1, there is illustrated a gas conditioning system that embodies the principles of the present invention for supply of seal gas to a gas lubricated, non-contacting gas seal. The system generally designated 10, including individual components discussed below, may be unitized as a single package on a movable skid. It may be positioned in association with an existing rotary device equipped with one or more gas lubricated non-contacting seals, or it may be part of an installation of new equipment where gas lubricated, non-contacting seals are to be used. Previously mentioned U.S. Pat. No. 6,345,954, the disclosure of which is hereby incorporated by reference into this specification, is illustrative of the state of the art of an application in which the present invention may be employed.

Connection of the system 10 to the equipment in which the seals are used may occur through suitable ports in a gas control panel shown schematically at 11 in FIG. 1. One manufacturer of such gas panels is John Crane Lemco, of Tulsa, Okla. Such control panels are typically located adjacent the rotary equipment being sealed and contain valves and gauges that reflect seal operation. It is contemplated that the system of the present invention may be incorporated with a gas panel as a single unitized module.

As seen in FIG. 1, the system 10 includes a connection 12 to piping connected to a source of gas for supply to the seal chamber in which there is disposed a gas lubricated, non-contacting gas seal. As is known in the art, this source could be the discharge end of a gas compressor in which gas lubricated, non-contacting seals are employed. Such a source is typically available at the gas control panel 11. In other installations, such as turbo-expanders, the source would be the high pressure end of the rotary machine.

Alternatively, the source of gas could be fuel gas used to fuel associated gas turbines, or it could be a manifold in a gas transmission system that receives the output of a number of separate compressors.

The system 10 includes a connection 14 to piping adapted to be placed in communication with a seal chamber within the device. Such connection may communicate with more than one seal chamber, depending on the number of seals employed in the device.

The major conditioning elements of the system of the present invention are elements to remove solid and liquid particulate matter and aerosols from the gas, and to heat or amplify pressure of the gas when necessary. There is illustrated a knock-out filter/coalescer vessel 16, a pressure vessel 18, a gas heating element 22 and a pressure amplifier 20. These components are connected in fluid communication by piping or conduit, generally designated 15, that defines a flow path between the gas supply connection 12 and the connection 14 to the seal chamber.

The system 10 also includes a sensing mechanism illustrated as a pressure sensor 24, mounted on the pressure vessel 18 to sense a condition of the gas, in this embodiment the gas pressure within the vessel. The sensing mechanism could, however, be mounted elsewhere in the system, such as in the line 15.

The pressure sensor may be a pressure switch or a pressure transmitter or any other well known and commonly available sensing mechanism responsive to pressure.

A gas temperature monitor 26 may be mounted on the pressure vessel 18 to monitor the temperature of the gas to be supplied to the seal chamber. Alternatively, it may be mounted in line 15 downstream of vessel 18, as illustrated in FIG. 1.

In an alternative arrangement, a dew point sensor can be substituted for the temperature sensor 26. Either of these sensors cold be mounted in line 15 or vessel 18.

Piping 15 associated with each of the system components is provided with suitable shut-off valves 40 and by-pass valves 42, such that each component may be removed from the system for repair or replacement, as necessary. Check valves 44 are in place in the system piping to prevent reverse flow from the connection 14 associated with the seal chamber to the connection 12 associated with the gas supply.

Notably, the piping 15 defines parallel fluid paths 15*a* and 15*b* between the knock-out filter/coalescer vessel 16 and pressure vessel 18. The pressure amplifier 20 is in one branch 15*b* of these paths. With such an arrangement, a flow path to the pressure vessel 18 exists regardless of whether the pressure amplifier 20 is operating.

The knock-out filter-coalescer vessel 16 is a device that removes particulate matter and liquid droplets from the gas flowing through the system. It includes a baffle plate designated 16*a* to remove solid particulate and free liquid contained in the seal gas. This separated contamination settles at the bottom of the vessel 16 and is removable, either manually, or by an automated arrangement.

The seal gas is then further conditioned by purging it of entrapped liquid aerosols by the coalescing action of a filter element designated 16*b*.

A suitable device 16 is manufactured by John Crane Lemco, Tulsa, Okla. The knock-out plate 16*a* and coalescing filter 16*b* are known devices. Also, a centrifuge-type device could be employed in place of the knock-out plate. In such an arrangement, two separate vessels, one for the centrifuge, the other for the filter element, would make up the conditioning element 16.

Another option is to employ a device to remove specific contaminants known to be present in the gas to be supplied to the seal chamber. One such device contemplated is a mercury removal device that cleanses mercury from the gas. Such a device is available from Selexsorb, a division of Alcoa.

The pressure vessel 18 is a tank capable of maintaining gas under system pressure. Its volume is determined by the expected requirements of the seal in the seal chamber and labyrinth leakage rate. A suitable size is calculated for the particular application involved. Such tanks are commonly available and can withstand pressures up to 6,000 pounds per square inch gauge (psig)). Tanks manufactured by John Crane Lemco are suitable.

The heating element 22 is disposed within pressure vessel 18. Such elements manufactured by Watlow Electric Manufacturing Company, 12001 Lackland Road, St. Louis, Mo. 63146 are suitable for use in the system of the illustrated embodiment. The element is an electrical resistance heater and must be connected to a source of electrical power at the site. It is contemplated that a device having a rating of 100 kilowatts (kw) would be suitable.

The illustrated gas pressure amplifier 20 is a dual cylinder, piston compressor, one cylinder of which is a drive element, the other of which is a compression element. The drive cylinder is connected by a line 17 to a source of drive gas under pressure. The drive gas for the drive cylinder may be shop air, available at the site, at 70 to 150 psi(g). The piston of this drive element reciprocates in the drive cylinder in response to delivery of gas under pressure. This movement drives the compression piston in the compression cylinder.

The compression cylinder of the gas pressure amplifier 20 is in communication with the line 15*b* as part of the flow path to pressure vessel 18. The piston in the compression cylinder pressurizes the seal gas in the system for delivery to the pressure vessel 18.

The pistons of amplifier 20 are of a size ratio of 1 to 1.8. The larger piston is the drive piston that receives gas under pressure through line 17. The smaller, compression piston compresses seal gas from gas supply connection 12 for delivery to pressure vessel 18.

A device suitable for the illustrated system is a pressure amplifier manufactured by Haskel International, Inc., 100 East Graham Place, Burbank, Calif. 91502. It should be noted, however, that the gas compressor in line 15*b* could be driven by any form of power supply, such as a hydraulic or electric motor. Also, a centrifugal or diaphragm-type pressure amplifier could be employed.

The supply 17 includes a control mechanism in the form of a solenoid valve 46 to open the path from the supply 45 to the pressure amplifier 20 to control operation of the pressure amplifier. It is an electrically operable solenoid valve movable from a closed, to an open, position. A suitable valve 46 is a normally closed type with a CV value around 4.0. A suitable valve is made by ASCO. However, solenoid valves manufactured by any one of numerous manufacturers are well known in the art of flow control and would be suitable.

Circuitry, generally designated 30, connects sensor 24 and the solenoid valve 46. Valve 46 is controlled by pressure sensor 24 on vessel 18 through the circuitry 30. The sensing mechanism 24 energizes the valve 46 when the sensed pressure is at or below a pre-set level. On recognition of the pre-set pressure, pressure sensor 24 causes valve 46 to open to activate the pressure amplifier 20 to augment and maintain the pressure of the gas within the vessel 18.

By way of example, and not limitation, the system may be set to maintain the pressure within the vessel 18 at 600 psi(g). Should the pressure sensor 24 sense a pressure below that minimum, the circuitry will energize solenoid valve 46, causing it to open and activate pressure on amplifier 20 to deliver gas to the vessel 18 and raise the pressure. Once the pre-set pressure value is sensed, the circuitry de-energizes solenoid valve 46, and the pressure amplifier 20 is deactivated.

Circuitry, generally designated 32, connects the temperature sensor 26 and heating element 22 to control operation of the gas heating element 22 to maintain the temperature of the gas supplied to the seal chamber at a predetermined level.

A suitable temperature sensor is a type J thermocouple made by Watlow Electric Company. In this embodiment, it is disposed to sense the temperature in pressure vessel 18. It could, however, be positioned in the line leading to connection 14.

The temperature sensor 26 is arranged to recognize the temperature necessary to maintain a gaseous state for the fluid supplied to the seal chamber. It can be set based on knowledge of the parameters of the gas being sealed and the equipment specifications. The temperature responsive sensor 26 will initiate power to the gas heating element 22 should the temperature sensed by sensor 26 be below an established minimum. It will disconnect the power to the heating element 22 when the sensed temperature reaches the pre-set value. As an example, the temperature could be set to energize the heating element 22 if the sensed temperature is 250° Fahrenheit (° F.) or less, and set to de-energize the heating element if the pre-set temperature value is sensed.

If a dew point sensor is used, it is set to energize the heating element 22 if the dew point is below a predetermined and pre-set level, and to de-energize the heating element if the dew point sensed is at the predetermined pre-set level.

Figure 2:
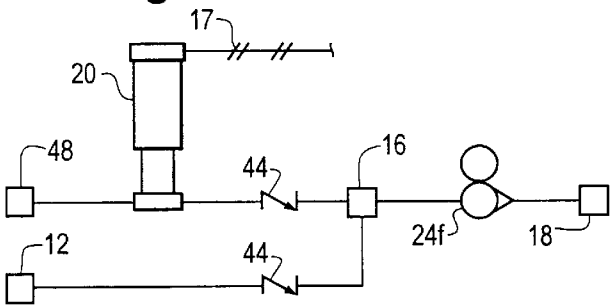
FIG. 2 is a partial schematic view of a gas supply system illustrating other embodiments of the invention.

FIG. 2 shows an alternative arrangement for a source of seal gas to be amplified by seal gas amplifier 20. In this embodiment, except as discussed below, the remainder of the system is the same as illustrated in FIG. 1.

In the alternative arrangement, the compression cylinder of pressure amplifier 20 is not connected to the source of seal gas at gas supply connection 12. Rather, a second source 48 of seal gas is connected by piping to the compression cylinder of amplifier 20. This source may be, for example, the suction side or low pressure side of the machine employing the gas lubricated, non-contacting seals. In a gas compressor, connection 48 would be to the inlet or suction side of the compressor or an inlet manifold serving several compressors. In a turbo-expander, for example, connection 48 would be to the outlet or low pressure end of the machine. This alternative source provides a source of gas for pressurization and delivery by the pressure amplifier 20 to the pressure vessel 18, and ultimately, to the seal chamber for non-contacting operation of the seal when the sensing mechanism senses the need for amplification of the gas supply.

To take advantage of the knock-out filter coalescer 16, the piping is arranged such that the discharge from the compression cylinder 20 is delivered to the system upstream of element 16. The amplified seal gas passes from system element 16 to the pressure vessel 18.

In a system including the alternative source of gas 48, the pressure sensor 24, circuitry 30 and solenoid valve 46 would operate as described in connection with FIG. 1. Similarly, the temperature sensor 26, circuitry 32 and heating element 22 would operate as described with reference to the embodiment of FIG. 1.

An alternative form of sensing mechanism 24 may also be employed. In the system illustrated in FIG. 2, a flow meter **24*f* in line 15 is the sensing mechanism. It senses the condition of flow of the seal gas through the system. It is connected through circuitry 30 to control mechanism 46 to energize and de-energize the solenoid valve and activate or de-activate pressure amplifier 20. When sensed flow at flow meter 24*f* is below a pre-set minimum, control mechanism 46 activates the pressure amplifier 20. When the flow is at or above a pre-set maximum, the flow meter 24*f*, through circuitry 30, sends a signal to de-energize control mechanism 46 to de-activate pressure amplifier 20**.

Various features of the present invention have been described with reference to the particular embodiments. It should be understood that modifications may be made without departing from the spirit and scope of the invention as represented by the following claims.

What is claimed is:

1. A system of gas conditioning elements for supply of seal gas to the seal chamber of a rotary machine employing at least one gas lubricated, non-contacting seal comprising:

conduit defining a fluid path and having;

a connection adapted to be connected to a source of gas to be supplied to the seal chamber;

a connection adapted to be connected to the seal chamber;

a knock-out filter to remove solid and free liquid particles and a coalescer to remove aerosols from the gas connected to said conduit in said fluid path between said connections; and a pressure vessel connected to said conduit in said fluid path between said knock-out filter and said coalescer and said connection adapted to be connected to the seal chamber.

2. A system of gas conditioning elements for supply of seal gas as claimed in claim 1 wherein said knock-out filter and coalescer are contained in a single vessel.

3. A system of gas conditioning elements for supply of seal gas as claimed in claim 1 wherein said system further includes:

a heating element in said pressure vessel; a temperature sensing mechanism adapted to sense the temperature of said gas to be supplied to the seal chamber;

circuitry connected between said temperature sensing mechanism and said heating element to control operation of said heating element in response to the sensed temperature of the gas to be supplied to the seal chamber.

4. A system of gas conditioning elements for supply of seal gas as claimed in claim 3 wherein said gas conditioning elements are contained on a single movable skid.

5. A system of gas conditioning elements for supply of seal gas as claimed in claim 3 wherein said knock-out filter and coalescer are contained in a single vessel.

6. A system of gas conditioning elements for supply of gas as claimed in claim 3 wherein:

said temperature sensing mechanism is mounted on said pressure vessel to sense the temperature of the gas in said pressure vessel; and wherein said temperature sensing mechanism, said heating element and said circuitry are arranged to energize said heating element when the temperature of the gas is below a pre-set value and de-energize said heating element when the pre-set value is sensed.

7. A system of gas conditioning elements for supply of seal gas as claimed in claim 3, said system further comprising:

a seal gas pressure amplifier connected to said conduit between said knock-out filter and said coalescer and said connection adapted to be connected to the seal chamber, said pressure amplifier including a drive element and a gas compression element;

a sensing mechanism adapted to sense a condition of the seal gas to be supplied to the seal chamber;

a control mechanism connected to said drive element, and circuitry connected between said sensing mechanism and said control mechanism such that said control mechanism is responsive to the sensed condition of the gas to be supplied to the seal chamber to control operation of said pressure amplifier.

8. A system of gas conditioning elements for supply of seal gas as claimed in claim 7 wherein said knock-out filter and coalescer are contained in a single vessel.

9. A system of gas conditioning elements for supply of seal gas as claimed in claim 7 wherein said gas conditioning elements are contained on a single movable skid.

10. A system of gas conditioning elements for supply of seal gas as claimed in claim 7 wherein said sensing mechanism is a pressure sensing mechanism to sense the pressure of said gas to be supplied to the seal chamber.

11. A system of gas conditioning elements for supply of seal gas as claimed in claim 10 wherein said gas compression element is a gas compressor and wherein said pressure sensor is mounted on said pressure vessel.

12. A system of gas conditioning elements for supply of seal gas as claimed in claim 1, said system further comprising:

a seal gas pressure amplifier connected to said conduit between said knock-out filter and coalescer and said connection adapted to be connected to the seal chamber, said pressure amplifier including a drive element and a gas compression element;

a sensing mechanism adapted to sense a condition of the seal gas to be supplied to the seal chamber;

a control mechanism connected to said drive element, and circuitry connected between said sensing mechanism and said control mechanism such that said control mechanism is responsive to the sensed condition of the gas to be supplied to the seal chamber to control operation of said pressure amplifier.

13. A system of gas conditioning elements for supply of seal gas as claimed in claim 12 wherein said sensing mechanism is a pressure sensing mechanism to sense the pressure of said gas to be supplied to the seal chamber.

14. A system of gas conditioning elements for supply of seal gas as claimed in claim 13 wherein said gas compression element is a gas compressor and wherein said pressure sensor is mounted on said pressure vessel.

15. A system of gas conditioning elements for supply of seal gas as claimed in claim 14 wherein said control mechanism controls operation of said gas compressor in response to sensed pressure of the seal gas to be supplied to the seal chamber.

16. A system of gas conditioning elements for supply of seal gas as claimed in claim 15 wherein said pressure sensing mechanism, said control mechanism and said circuitry are arranged to activate said gas compressor when the sensed pressure is below a pre-set value and de-activate said gas compressor when the sensed pressure reaches said value.

17. A system of gas conditioning elements for supply of seal gas as claimed in claim 16 wherein said control mechanism is an electrically operated solenoid valve connected between said drive element and a source of gas under pressure and wherein said solenoid valve is movable between closed and open positions in response to sensed pressure of the seal gas to be supplied to the seal chamber.

18. A system of gas conditioning elements for supply of seal gas as claimed in claim 17 wherein said pressure sensing mechanism, said solenoid valve and said circuitry are arranged to open said valve when the sensed pressure is below a pre-set value and close said valve when the sensed pressure reaches said value.

19. A system of gas conditioning elements for supply of seal gas as claimed in claim 1 wherein said knock-out filter and coalescer are contained in a single vessel.

20. A system of gas conditioning elements for supply of seal gas as claimed in claim 1 wherein said gas conditioning elements are contained on a single movable skid.

21. A system of gas conditioning elements for supply of seal gas to the seal chamber of a rotary machine employing at least one gas lubricated, non-contacting seal comprising:

conduit defining a fluid path and having;

a connection adapted to be connected to a source of gas to be supplied to the seal chamber;

a connection adapted to be connected to the seal chamber;

a knock-out filter to remove solid and free liquid particles and a coalescer to remove aerosols from the gas connected to said conduit in said fluid path between said connections; and a seal gas pressure amplifier connected to said conduit between said knock-out filter and said coalescer and said connection adapted to be connected to the seal chamber, said pressure amplifier including a drive element and a gas compression element;

a sensing mechanism adapted to sense a condition of the seal gas to be supplied to the seal chamber;

a control mechanism connected to said drive element, and circuitry connected between said sensing mechanism and said control mechanism such that said control mechanism is responsive to the sensed condition of the gas to be supplied to the seal chamber to control operation of said pressure amplifier.

22. A system of gas conditioning elements for supply of seal gas as claimed in claim 21 wherein said knock-out filter and coalescer are contained in a single vessel.

23. A system of gas conditioning elements for supply of seal gas as claimed in claim 21 wherein said gas conditioning elements are contained on a single movable skid.

24. A system of gas conditioning elements for supply of seal gas as claimed in claim 21 wherein said sensing mechanism is a pressure sensing mechanism to sense the pressure of said gas to be supplied to the seal chamber.

25. A system of gas conditioning elements for supply of seal gas as claimed in claim 24 wherein said gas compression element is a gas compressor and wherein said pressure sensor is mounted on said pressure vessel.

26. A system of gas conditioning elements for supply of seal gas as claimed in claim 25 wherein said control mechanism controls operation of said gas compressor in response to sensed pressure of the seal gas to be supplied to the seal chamber.

27. A system of gas conditioning elements for supply of seal gas as claimed in claim 26 wherein said pressure sensing mechanism, said control mechanism and said circuitry are arranged to activate said gas compressor when the sensed pressure is below a pre-set value and de-activate said gas compressor when the sensed pressure reaches said value.

28. A system of gas conditioning elements for supply of seal gas as claimed in claim 27 wherein said control mechanism is an electrically operated solenoid valve connected between said drive element and a source of gas under pressure and wherein said solenoid valve is movable between closed and open positions in response to sensed pressure of the seal gas to be supplied to the seal chamber.

29. A system of gas conditioning elements for supply of seal gas as claimed in claim 28 wherein said pressure sensing mechanism, said solenoid valve and said circuitry are arranged to open said valve when the sensed pressure is below a pre-set value and close said valve when the sensed pressure reaches said value.

30. A system for supply of seal gas to the seal chamber of a rotary machine employing at least one gas lubricated, non-contacting seal comprising:

a seal gas pressure amplifier connected between a source of gas to be supplied to the seal chamber and a connection adapted to be connected to the seal chamber, said pressure amplifier including a drive element and a gas compression element;

a sensing mechanism adapted to sense a condition of the seal gas to be supplied to the seal chamber;

a control mechanism connected to control operation of said drive element, and circuitry connected between said sensing mechanism and said control mechanism such that said control mechanism responsive to the sensed condition of the gas to be supplied to the seal chamber.

31. A system for supply of seal gas as claimed in claim 30 wherein said system includes a pressure vessel connected to said pressure amplifier and connected to said connection adapted to be connected to the seal chamber, and wherein said sensing mechanism is a pressure sensing mechanism to sense the pressure of said gas to be supplied to the seal chamber.

32. A system for supply of seal gas as claimed in claim 31 wherein said system includes a knock-out filter/coalescer connected to the source of gas, said system includes piping defining parallel paths between said knock-out filter/coalescer and said pressure vessel and said compression element of said pressure amplifier is disposed in one of said paths.

33. A system for supply of seal gas as claimed in claim 32 wherein said compression element is a gas compressor.

34. A system for supply of seal gas as claimed in claim 33 wherein said drive element is driven by gas under pressure, and wherein said control mechanism is an electrically operated solenoid valve connected between said drive element and a source of gas and wherein said solenoid valve is movable between closed and open positions in response to sensed pressure of the seal gas to be supplied to the seal chamber.

35. A system for supply of seal gas as claimed in claim 34 wherein said pressure sensing mechanism is mounted on said pressure vessel to sense the pressure of the gas in said vessel and wherein said pressure sensing mechanism, said solenoid valve and said circuitry are arranged to open said valve when the sensed pressure in said pressure vessel is below a pre-set value and close said solenoid valve when the sensed pressure reaches such value.

36. A system for supply of gas as claimed in claim 32 wherein said system includes:

a heating element in said pressure vessel;

a temperature sensing mechanism adapted to sense the temperature of said gas to be supplied to the seal chamber;

circuitry connected between said temperature sensing mechanism and said heating element to control operation of said heating element in response to the sensed temperature.

37. A system for supply of gas as claimed in claim 36 wherein:

said temperature sensing mechanism is mounted on said pressure vessel to sense the temperature of the gas in the pressure vessel; and wherein said temperature sensing mechanism, said heating element and said circuitry are arranged to energize said heating element when the temperature of the gas is below a pre-set value and de-energize said heating element when the pre-set temperature is reached.

38. A system for supply of seal gas as claimed in claim 31 wherein said gas compression element is a gas compressor and wherein said pressure sensor is mounted on said pressure vessel.

39. A system for supply of seal gas as claimed in claim 38 wherein said control mechanism controls operation of said gas compressor in response to sensed pressure of the seal gas to be supplied to the seal chamber.

40. A system for supply of seal gas as claimed in claim 39 wherein said pressure sensing mechanism, said control mechanism and said circuitry are arranged to activate said gas compressor when the sensed pressure is below a pre-set value and de-activate said gas compressor when the sensed pressure reaches said value.

41. A system for supply of seal gas as claimed in claim 40 wherein said drive element is driven by gas under pressure sufficient to drive said gas compressor.

42. A system for supply of seal gas as claimed in claim 41 wherein said control mechanism is an electrically operated solenoid valve connected between said drive element and a source of gas under pressure and wherein said solenoid valve is movable between closed and open positions in response to sensed pressure of the seal gas to be supplied to the seal chamber.

43. A system for supply of seal gas as claimed in claim 42 wherein said pressure sensing mechanism, said solenoid valve and said circuitry are arranged to open said valve when the sensed pressure is below a pre-set value and close said valve when the sensed pressure reaches said value.

44. A system for supply of gas as claimed in claim 31 said system includes:

a heating element in said pressure vessel;

a temperature sensing mechanism adapted to sense the temperature of said gas to be supplied to the seal chamber;

circuitry connected between said temperature sensing mechanism and said heating element to control operation of said heating element in response to the sensed temperature of the gas to be supplied to the seal chamber.

45. A system for supply of gas as claimed in claim 44 wherein:

said temperature sensing mechanism is mounted on said pressure vessel to sense the temperature of the gas in said pressure vessel; and wherein said temperature sensing mechanism, said heating element and said circuitry are arranged to energize said heating element when the temperature of the gas is below a pre-set value and de-energize said heating element when the pre-set temperature value is sensed.

46. A system for supply of seal gas as claimed in claim 44 wherein said compression element is a gas compressor and wherein said pressure sensor is mounted on said pressure vessel.

47. A system for supply of seal gas as claimed in claim 46 wherein said control mechanism is an electrically operated solenoid valve connected between said drive element and a source of gas under pressure and wherein said solenoid valve is movable between closed and open positions in response to sensed pressure of the seal gas to be supplied to the seal chamber.

48. A system for supply of seal gas as claimed in claim 47 wherein said pressure sensing mechanism, said solenoid valve and said circuitry are arranged to open said valve when the sensed pressure is at or below a pre-set value and close said valve when the sensed pressure reaches such value.

49. A system for supply of seal gas as claimed in claim 30 wherein said sensing mechanism is a flow meter to sense the flow of gas through said system and wherein said flow meter, said control mechanism and said circuitry are arranged to activate said pressure amplifier when said sensed flow is below a pre-set value, and de-activate said pressure amplifier when said sensed flow reaches said value.

50. A system for supply of seal gas as claimed in claim 49 wherein said compression element is a gas compressor and wherein said drive element is driven by gas under sufficient pressure to drive said gas compressor, and wherein said control mechanism is an electrically operated solenoid valve connected between said drive element and a source of gas under pressure and wherein said solenoid valve is movable between closed and open positions in response to sensed flow of the gas to be supplied to the seal chamber.

51. A system for supply of seal gas as claimed in claim 50 wherein said flow meter is mounted to sense the flow of the gas in said system and wherein said flow meter, said solenoid valve and said circuitry are arranged to open said valve when the flow in said system is below a pre-set value and close said valve when the sensed flow reaches such value.

52. A system for supply of gas as claimed in claim 30 wherein said system includes a first source of gas to be delivered to the seal chamber when said pressure amplifier is de-activated and a second source of gas connected to said pressure amplifier to be delivered to said seal chamber when said pressure amplifier is activated.

53. A system for supply of gas as claimed in claim 52 wherein said first source of seal gas is connected to a knock-out filter and a coalescer in a first fluid path and said second source of seal gas is connected to said pressure amplifier, and said pressure amplifier is connected to said knock-out filter coalescer, said knock-out filter coalescer is in fluid communication with said connection adapted to be connected to the seal chamber.

54. A system for supply of seal gas to the seal chamber of a rotary machine employing at least one gas lubricated, non-contacting seal comprising:

a first source of gas to be supplied to the seal chamber connected through said system to a connection adapted to be connected to the seal chamber;

a second source of gas to be supplied to the seal chamber;

a seal gas pressure amplifier connected to said second source of gas and through said system to said connection adapted to be connected to the seal chamber;

said pressure amplifier including a drive element and a gas compression element connected thereto;

a sensing mechanism adapted to sense a condition of the seal gas to be supplied to the seal chamber;

a control mechanism to control operation of said drive element, and circuitry connected between said sensing mechanism and said control mechanism such that said control mechanism is controlled in response to the sensed condition of the gas to be supplied to the seal chamber.

55. A system for supply of seal gas as claimed in claim 54 wherein said system includes a pressure vessel connected to said pressure amplifier and connected to said connection adapted to be connected to the seal chamber, and wherein said sensing mechanism is a pressure sensing mechanism to sense the pressure of said gas to be supplied to the seal chamber.

* * * * *